United States Patent [19]

Bauer

[11] Patent Number: 4,662,568

[45] Date of Patent: May 5, 1987

[54] JET BREAK-UP DEVICE FOR SPRAY NOZZLE APPLICATIONS

[76] Inventor: Peter Bauer, 13921 Esworthy Rd., Germantown, Md. 20874

[21] Appl. No.: 698,502

[22] Filed: Feb. 5, 1985

Related U.S. Application Data

[63] Continuation-in-part of Ser. No. 425,344, Sep. 28, 1982, abandoned.

[51] Int. Cl.[4] ..... B05B 1/08

[52] U.S. Cl. ..... 239/589.1; 239/590.5

[58] Field of Search ..... 239/101, 102, 461, 498, 239/500, 502, 522, 548, 590, 590.5, 11, 428.5, DIG. 3, 590.3, 589.1

[56] References Cited

U.S. PATENT DOCUMENTS

| | | | |
|---|---|---|---|
| Re. 27,938 | 3/1974 | Bauer | 239/102 |
| 1,659,538 | 2/1928 | Angrove | 239/500 |
| 3,511,255 | 5/1970 | Bauer | 137/8.5 |
| 3,656,464 | 4/1972 | Hilborn | 239/590.3 |
| 3,841,568 | 10/1974 | Broad | 239/590 |
| 4,079,868 | 3/1978 | Moniot | 239/590 |
| 4,176,794 | 12/1979 | Allenbaugh | 239/500 |
| 4,184,636 | 1/1980 | Bauer | 239/11 |
| 4,210,283 | 7/1980 | Stouffer | 239/590 |
| 4,221,336 | 9/1980 | Diamond | 239/428.5 |
| 4,393,991 | 7/1983 | Jeffras et al. | 239/102 |
| 4,463,904 | 8/1984 | Bray | 239/590 |

*Primary Examiner*—Andres Kashnikow
*Assistant Examiner*—Michael J. Forman
*Attorney, Agent, or Firm*—Griffin, Branigan & Butler

[57] ABSTRACT

A spray nozzle is provided with various surface configurations within a chamber to stress the liquid flow therein whereby the liquid issues from the nozzle as individual drops of liquid in a stressed state so as to further break up into smaller drops after leaving the nozzle.

8 Claims, 29 Drawing Figures

JET BREAK-UP DEVICE FOR SPRAY NOZZLE APPLICATIONS

This application is a continuation-in-part of my copending application No. 425,344 (now abandoned) filed Sept. 28, 1982 and having the same title.

BACKGROUND OF THE INVENTION

Liquid spray nozzles, from which jets or streams of various cross-sections issue in operation, in most cases produce a cohesive jet at the exit of the nozzle. The jet tends to break up into irregular packages of liquid after travelling over some distance through the ambient air (gas). The liquid packages usually break up further into droplets as they travel farther. The breakup of the originally cohesive stream is caused by a number of basic physical phenomena resulting in instabilities of such free jets and thus a loss of cohesion with a consequent division of the jet into isolated particles or droplets. Since spray nozzles are mostly intended for the generation of a directed "spray", i.e. a predetermined moving cloud of droplets, such nozzles have been designed to promote the jet breakup by various designs of the nozzle flow guiding structures and the nozzle exits. Additionally, jet breakup has been induced by externally imposed or internally generated vibratory effects, etc. In recent years, spray nozzles functioning on the basis of fluidic mechanisms have become known, these nozzles containing fluidic oscillators which generate oscillatory or sweeping jets at the exits of the nozzles. In these nozzles a motion usually transverse to the jet flow direction promotes the breakup into droplets.

In most situations it is desirable to generate droplet sprays as soon as possible after a jet issues from a nozzle, whether the spray is utilized to spray onto surfaces or whether it is intended to generate a cloud (the latter for example in gas scrubber applications). It is obvious that the sooner a jet is broken up into droplets after leaving the nozzle structure, the less distance is required between nozzle and the region where the droplets are intended to take effect, whatever such effect may be in a particular application.

Unfortunately, in spite of decades of design effort in the nozzle trade, most conventional nozzles issue an initially cohesive jet, albeit usually highly stressed by various mechanisms, which jet only gradually breaks up into droplets over some considerable distance downstream, depending on numerous factors. For instance, a conventional nozzle generates a jet which may not start to break up until some distance downstream from the nozzle exit which distance may be ten to a hundred or even a thousand times the width of the nozzle outlet opening. In general, higher supply pressures and thus higher flow velocities are required to effect earlier jet breakup. In many applications fluidic oscillator nozzles have allowed significant reductions in supply pressure requirements in comparison with conventional nozzles whilst generating the same or even improved spray performance and breaking up the stream issuing from the nozzle at shorter distances from it.

An early jet breakup into droplets is desirable for a number of reasons. For instance, spraying a wide angle fan spray onto a surface is generally very advantageous when the sprayed fluid has the shortest distance to travel before impact, because the sprayed liquid is least exposed to ambient conditions, does not dry out or evaporate as much, does not deflect as much if exposed to air currents, does not get contaminated as much, etc., all in comparison with conventional nozzle spray performance. Naturally, space and distance is at a premium in many applications, and a reduction in the spray nozzle distance requirements is a great advantage. Longer spray distances may also cause continuing breakup into smaller undesirable droplet sizes, loss of momentum and controllability, particularly in the presence of transverse wind or other gas currents, and may force higher pressures and thus higher power consumption than needed when an early jet breakup is facilitated.

The present invention improves such performance significantly in that it not only causes much earlier breakup, but it forces the jet to break up within the nozzle structure or at its exit before the fluid exits from the nozzle. Additionally this breakup is amenable to various design measures, as it is caused by structural influences within the nozzle. Therefore, a considerable degree of control of the breakup mechanism is offered by the present invention.

SUMMARY OF THE INVENTION

An object of the present invention is to provide a spray nozzle having means for causing the breakup of a sweeping liquid jet into discrete packages or drops before the liquid comprising the jet is issued from the nozzle. Physical obstructions and/or flow guiding or flow stressing means within the flow path in the outlet region of the nozzle enforce a separation of the cohesive flow into discrete packages at, or upstream of, the nozzle outlet.

In a preferred embodiment the sweeping liquid jet is directed into a chamber having an outlet to the ambient temperature and one or more vane-like, wire, pin, or needle-like elements disposed at the outlet or slightly upstream therefrom to break the jet up into discrete packages or drops of liquid which then exit from the nozzle. Alternatively at least one surface of the chamber upstream of the nozzle outlet is made uneven or is provided with recesses or slots or undulations to thereby stress the liquid jet and induce it to break up into drops before it exits from the nozzle.

A further object of the invention is to provide a spray nozzle responsive to first and second liquid flows of varying amplitude and different phase, said nozzle comprising a chamber responsive to the first and second liquid flows and having means therein for stressing the resultant flow whereby liquid issues from the nozzle as discrete drops having a tendency to further subdivide after exiting from the nozzle.

Other objects of the invention and its mode of operation will become apparent upon consideration of the following description and the accompanying drawings.

DETAILED DESCRIPTION OF THE INVENTION

Figure 1A:
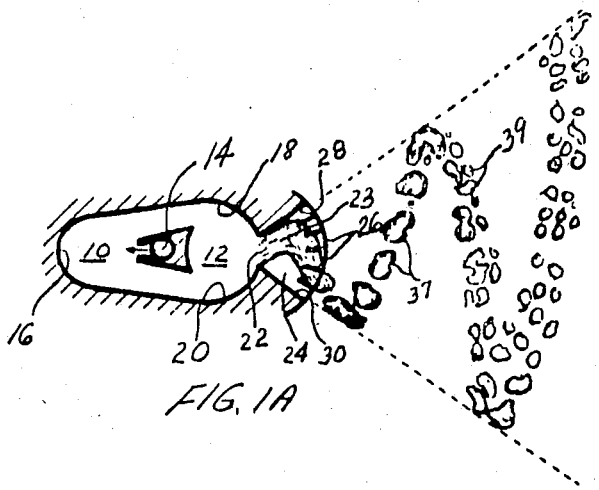
FIG. 1A is a top sectional view showing an oscillator, a chamber for issuing a swept liquid jet, and a chamber for inducing stress in the swept jet.
Figure 1C:
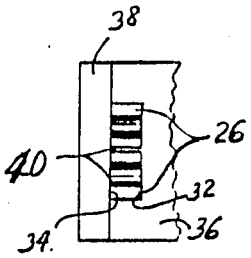
FIG. 1C is a right side view of FIG. 1A.
Figure 1B:
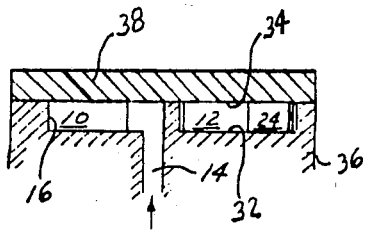
FIG. 1B is a horizontal sectional view of FIG. 1A.

FIGS. 1A–1C illustrate a spray nozzle constructed in accordance with the principles of the present invention and used in conjunction with an oscillator 10 and a spray forming output chamber 12 as disclosed in my U.S. Pat. No. 4,184,636. The oscillator includes an inlet 14 for directing a flowing liquid stream into an oscillator chamber 10 and against an end wall 16 of the oscillator chamber. As explained in the aforementioned patent, the liquid stream entering the chamber 10 is influenced by vortices formed in the chamber so that it is broken up into first and second liquid flows of varying amplitude and different phase. The spray forming chamber 12 has first and second peripheral walls 18 and 20 which are extensions of the side walls of the chamber 10 so that the inlet of chamber 12 coincides with the outlet of the oscillator. At their downstream ends walls 18 and 20 terminate at an outlet means or opening 22. As further explained in U.S. Pat. No. 4,184,636, the first and second fluid flows from oscillator chamber 10 are directed into chamber 12 substantially parallel to walls 18 and 20 and create vortex flows of varying magnitudes in chamber 12. The vortex action in chamber 12 causes the resultant flow to issue from outlet 22 in the form of a continuous fluid jet 23 which is swept back and forth.

In the aforementioned patent, the swept jet issuing from the spray nozzle normally begins breaking up only after it has issued from the nozzle into the ambient environment through outlet 22. To provide a breakup of the jet before it exits from the nozzle, the present invention contemplates, in one arrangement, the provision of a further chamber 24 having means therein for stressing the swept jet issuing through outlet 22 to thereby break the jet into discrete drops before it exits from the nozzle. The chamber 24 has an inlet coinciding with outlet 22, an outlet means 26 or opening, and first and second side walls 28 and 30 extending between the inlet and the outlet means 26. The walls 28 and 30 define first and second limits between which the jet is swept. The chamber 24 has a third or top wall 34 and a fourth or bottom wall 32 extending between the side walls 28 and 30. The entire nozzle structure may comprise a first body 36 having the configuration of passages and chambers as described above, and a cover plate 38 suitably affixed to the body 36.

The means for stressing the swept liquid jet comprises one or more divider elements 40 disposed in an arc coinciding with the plane in which the liquid jet is swept. FIG. 1 shows five divider elements but it will be understood that more or fewer divider elements may be utilized depending upon the characteristics desired in the spray issuing from the nozzle. As the number of divider elements is increased, the number of individual drops of liquid issuing from the nozzle on a single sweep of the jet is increased with a corresponding decrease in the size of the drops. A fewer number of divider elements results in fewer drops per sweep, the drops being larger in size.

The present invention is based on the mechanisms involved in jet or flow cohesion and breakup. One of these mechanisms is liquid surface tension which holds flow together, particularly free flow patterns unbounded partially or wholly by structural walls. Surface tension is opposed by inertial, gravitational, shear and other forces, and instabilities resulting from the simultaneous effect of these within moving and accelerating and decelerating flows. Division of flows by means of appropriate obstructions not only breaks surface tension films but also causes deformation, shear, momentum redirection, etc. in a rather non-uniform fashion such that portions of the flow become highly stressed and instabilities are promoted. The instabilities promoted tend to break up flowing liquid "packages" or drops 37 into smaller portions or droplets 39 after the drops have issued from the nozzle.

The simplest mechanism for subdividing flow into discrete separate flows is by flow-dividing vane-like obstructions like divider elements 40. These divider elements separate the swept jet flow into "packages" or large drops which exit from the nozzle through the openings between dividers 40. Further, the dividers generate stresses and instabilities in the large drops such that they more readily break up into smaller droplets after exiting from the nozzle.

Figure 2A:
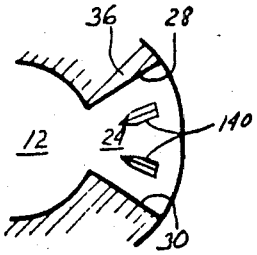
FIG. 2A is a top sectional view of a chamber having divider elements therein.
Figure 2B:
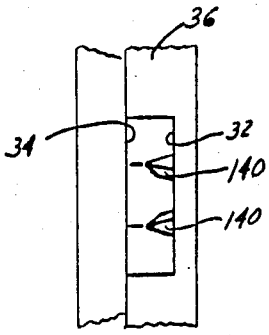
FIG. 2B is a right side view of FIG. 2A.
Figure 2C:
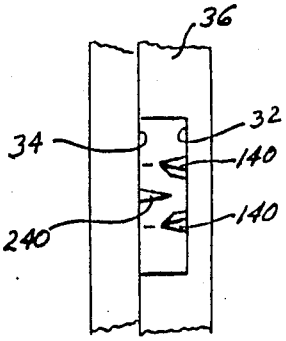
FIG. 2C is similar to FIG. 2B but shows divider elements extending into a chamber from opposing walls.

The divider elements of FIGS. 1A–1C extend from bottom wall 32 to top wall 34. However, other divider arrangements may be provided. FIGS. 2A, 2B and 2C show arrangements wherein the divider elements extend only part way between bottom wall 32 and top wall 34. In FIG. 2B the divider elements 140 protrude from bottom wall 32 part way toward top wall 34 and in FIG. 2C divider elements 140 extend from bottom wall 32 while a divider element 240 extends part way from top wall 34 toward bottom wall 32.

Figure 3A:
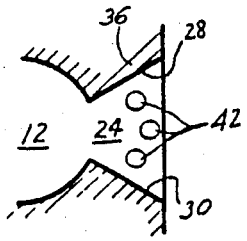
FIG. 3A is a top sectional view of a chamber with recesses therein.
Figure 3B:
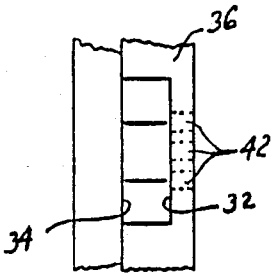
FIG. 3B is a right-side view of FIG. 3A.
Figure 3C:
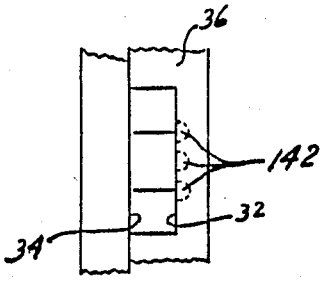
FIG. 3C is similar to FIG. 3B but shows recesses extending only part way into a chamber wall.

The means for stressing the swept liquid jet may take forms other than vane-like dividing elements. In FIGS. 3A and 3B, the means for stressing the swept liquid jet comprises a plurality of recesses 42 in the wall 32. The recesses 42 may extend through the wall 32 to the ambient environment surrounding the nozzle, as illustrated in FIG. 3B, or may be blind recesses such as recesses 142 (FIG. 3C) which extend only part way through the wall 32.

Figure 4A:
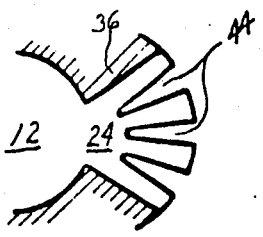
FIG. 4A is a top sectional view of a chamber with slots.
Figure 4B:
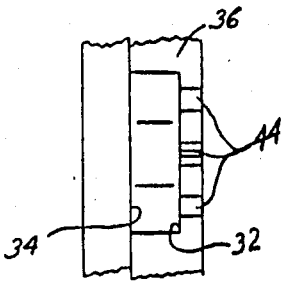
FIG. 4B is a right-side view of FIG. 4A.
Figure 4C:
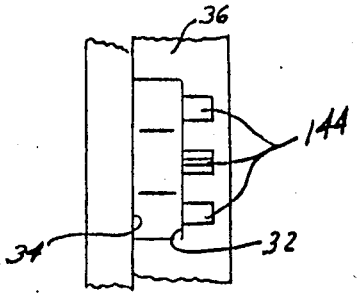
FIG. 4C is similar to FIG. 4B but shows slots extending only part way into a wall.

The recesses 42 and 142 are surrounded peripherally by that portion of body 36 which forms wall 32. However, the recesses may take the form of elongated slots 44 (FIG. 4A) which either extend completely through the wall 32 to the ambient environment as illustrated by slots 44 (FIG. 4B), or extend only partially through the wall 32 as illustrated by slots 144 (FIG. 4C). By extending the slots through wall 32, an aspiration of air from the environment surrounding the nozzle causes a constriction (and acceleration) of the flow in selected areas, thus further aiding in the breakup of the swept jet.

The recesses and slots 42, 142, 44 and 144 may vary in number, may take various shapes, and may be located and oriented in different ways. Their primary purpose is to stress the flow in chamber 24 such that the flow subdivides before it exits from the nozzle.

Figure 5A:
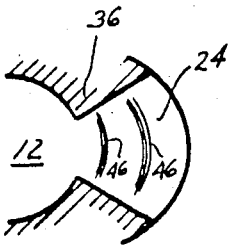
FIGS. 5A, 5B and 5C are top sectional, side and horizontal sectional views, respectively, of a chamber having undulations therein for inducing stress in a flowing fluid.
Figure 5B:
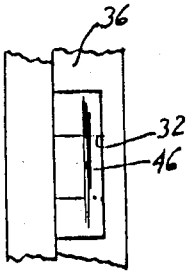
Figure 5C:
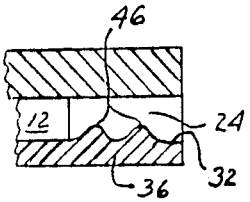

FIGS. 5A–5C illustrate a further embodiment of the invention wherein the means for stressing the flow in chamber 24 comprises an undulation or waving surface on the wall 32 where it bounds chamber 24. The undulation may comprise one or more elongated peaks 46 which may extend in an arc. The peaks may, or may not have the same height.

The foregoing embodiments all provide for a further chamber 24 downstream of a chamber 12 which produces a swept jet. In some cases it may be possible to dispense with chamber 24 and provide chamber 12 with a means for stressing the flow therein such that individual droplets issue directly from the outlet means 22 of chamber 12.

Figure 6A:
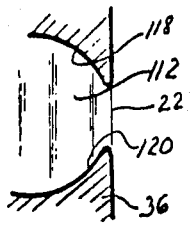
FIGS. 6A, 6B and 6C are top sectional, right side and horizontal sectional views, respectively, showing a chamber for producing liquid drops from alternating fluid flows.
Figure 6B:
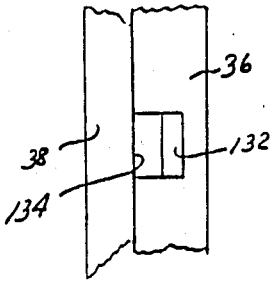
Figure 6C:
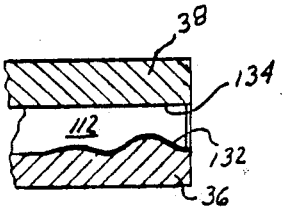

In FIGS. 6A–6C, a chamber 112 is similar to chamber 12 of FIG. 1A except that it is provided with an undulation or wavy surface. The wavy surface is shown as being provided on the wall 132 but may be provided on the wall 134. The wavy surface stresses the flow in chamber 112 resulting from first and second liquid flows of varying amplitude and different phase directed into the chamber substantially parallel to the walls 18 and 20, thereby causing a breakup of the flow before it exits from the chamber through outlet 22.

Figure 7A:
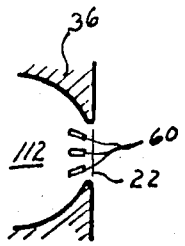
FIGS. 7A and 7B show a chamber similar to that of FIG. 6A but provided with flow dividing elements.
Figure 7B:
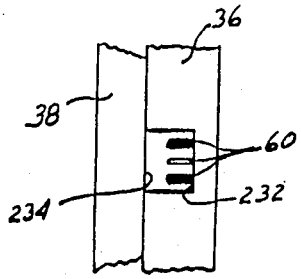
Figure 7C:
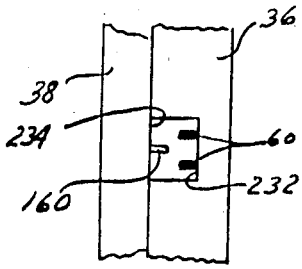
FIG. 7C is like FIG. 7B but shows dividing elements extending into a chamber from opposing walls

The means for stressing the flow in chamber 112 may take forms different from undulations. In FIGS. 7A and 7B, this means comprises a plurality of vane-like divider elements 60 extending into the chamber from the surface 232. One or more additional elements 160 may be provided on wall 234 in addition to, or instead of, the elements 60, as illustrated in FIG. 7C. The elements 60 and/or 160 are disposed upstream of the outlet 22.

Figure 8A:
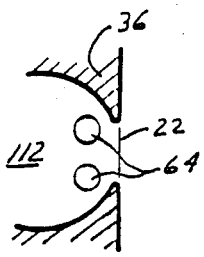
FIGS. 8A and 8B show a chamber similar to that of FIG. 6A but having recesses to induce stress in the fluid flow.
Figure 8B:
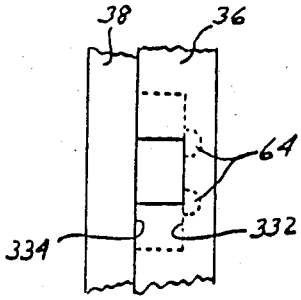

The means for stressing the flow in chamber 112 may also take the form of one or more recesses 64 disposed in a chamber wall upstream of the outlet 22. As illustrated in FIGS. 8A and 8B, the recesses 64 are located in wall 332 but they may be placed in wall 334 if desired.

Figure 9A:
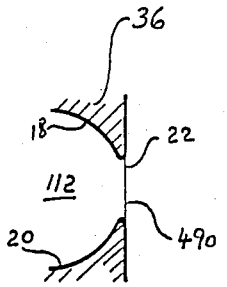
FIGS. 9A and 9B show a chamber similar to that of FIG. 6A but having one or more wires or pins extending across the outlet to induce stress in the fluid flow.
Figure 9B:
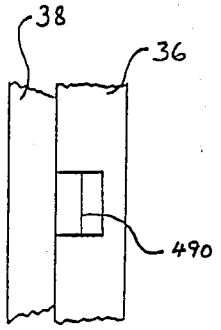

In FIGS. 9A–9B, a chamber 112 is similar to chamber 12 of FIG. 1A, except that a wire 490 is provided between peripheral walls 18 and 20 at opening 22. In this respect, "wire" 490 is used in the sense of a wire-like, needle-like, or pin like member and promotes generation of stresses in the flow at outlet opening 22.

Figure 10A:
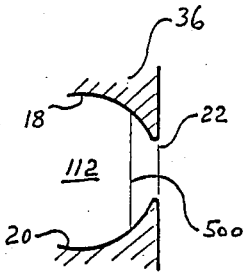
FIGS. 10A and 10B show a chamber similar to that of FIG. 6A but having one or more wires or pins extending across the chamber to induce stress in the fluid flow; and, FIGS. 11A and 11B show a chamber similar to that of FIG. 2A but show one or more wires or pins extending across the chamber.
Figure 10B:
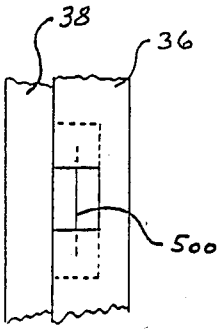

FIGS. 10A–10B show a similar arrangement as FIGS. 9A–9B, except that a wire or pin-like member 500 extends between peripheral walls 18 and 20 in chamber 112, substantially upstream from outlet opening 22. Wire member 500 stresses the flow in chamber 112 resulting from first and second liquid flows of varying amplitude and different phase directed into the chamber substantially parallel to the walls 18 and 20, thereby causing a breakup of the flow before it exits from the chamber through outlet 22.

Figure 11A:
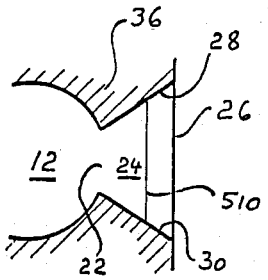
Figure 11B:
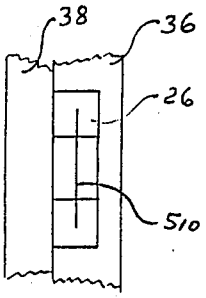

FIGS. 11A–11B show a similar chamber 12, outlet 22 and a further chamber 24 as in FIG. 1A, except that a wire or pin-like member 510 is provided between first and second side walls 28 and 30 in chamber 24 upstream from or at or near outlet 26. Again the wire member 510 serves to stress outflow to promote and cause breakup into further-stressed droplets before flow exits through outlet 26.

It should be noted that single or multiple wire or pin-like member arrangements may be utilized for the intended flow-stressing purposes and that other orientations than the ones shown in the Figures as examples may be adopted for wire-like members 490, 500, or 510.

While preferred embodiments of the invention have been shown to illustrate the principles of the invention, it will be understood that various modifications and substitutions may be made in the disclosed embodiments without departing from the spirit and scope of the invention as defined by the appended claims.

The embodiments of the invention in which an exclusive property or privilege is claimed are defined as follows:

1. A single-phase, liquid spray nozzle for subdividing a flowing liquid stream into discrete fluid drops and for issuing the drops in a spray pattern, said nozzle comprising:

means responsive to the flowing liquid stream for issuing a continuously-swept liquid jet which oscillates continuously back and forth between first and second limits; and, a stressing chamber comprised of:

inlet means for receiving said continuously-swept liquid jet;

outlet means through which discrete liquid drops may continuously pass to the ambient environment;

peripheral sidewalls extending between said inlet means and said outlet means;

means comprised of a plurality of stressing elements located in said chamber at said outlet means for stressing said continuously-swept liquid jet thereby causing said jet to subdivide into discrete drops which continuously issue from said stressing chamber through said outlet means in a continuously-swept pattern of drops rather than a jet; and, wherein said chamber has a first and second walls extending between said peripheral sidewalls and said plurality of stressing elements extend only part way from said first wall toward said second wall.

2. A single-phase, liquid spray nozzle for subdividing a flowing liquid stream into discrete fluid drops and for issuing the drops in a spray pattern, said nozzle comprising:

means responsive to the flowing liquid stream for issuing a continuously-swept liquid jet which oscillates continuously back and forth between first and second limits; and, a stressing chamber comprised of:

inlet means for receiving said continuously-swept liquid jet:

outlet means through which discrete liquid drops may continuously pass to the ambient environment;

peripheral sidewalls extending between said inlet means and said outlet means;

means comprised of a plurality of stressing elements located in said chamber upstream of said outlet means for stressing said continuously-swept liquid jet thereby causing said jet to subdivide into discrete drops which continuously issue from said stressing chamber through said outlet means in a continuously-swept patern of drops rather than a jet; and, wherein said chamber has first and second walls extending between said peripheral sidewalls and said plurality of stressing elements extend only part way from said first to said second wall.

3. A single-phase, liquid spray nozzle for subdividing a flowing liquid stream into discrete fluid drops and for issuing the drops in a spray pattern, said nozzle comprising:

means responsive to the flowing liquid stream for issuing a continuously-swept liquid jet which oscillates continuously back and forth between first and second limits; and, a stressing chamber comprised of:

inlet means for receiving said continuously-swept liquid jet;

outlet means through which discrete liquid drops may continuously pass to the ambient environment;

peripheral sidewalls extending between said inlet means and said outlet means;

means comprised of a plurality of stressing elements for stressing said continuously-swept liquid jet thereby causing said jet to subdivide into discrete drops which continuously issue from said stressing chamber through said outlet means in a continuously-swept pattern of drops rather than a jet; and, wherein said chamber has first and second walls extending between said peripheral sidewalls and said plurality of stressing elements comprises a plurality of slots in one of said first and second walls.

4. A spray nozzle as claimed in claim 3 wherein said slots extend through one of said first and second walls to permit ambient air to enter said chamber.

5. A spray nozzle as claimed in claim 4 wherein said slots are completely surrounded about their periphery by the wall in which they are located.

6. A spray nozzle as claimed in claim 3 wherein said slots extend into, but not completely through, one of said first and second walls.

7. A spray nozzle as claimed in claim 5 wherein said slots are completely surrounded about their periphery by the wall in which they are located.

8. A single-phase, liquid spray nozzle for subdividing a flowing liquid stream into discrete fluid drops and for issuing the drops in a spray pattern, said nozzle comprising:

means responsive to the flowing liquid stream for issuing a continuously-swept liquid jet which oscillates continuously back and forth between first and second limits; and, a stressing chamber comprised of:

inlet means for receiving said continuously-swept liquid jet;

outlet means through which discrete liquid drops may continuously pass to the ambient environment;

peripheral sidewalls extending between said inlet means and said outlet means;

means comprised of a plurality of stressing elements for stressing said continuously-swept liquid jet thereby causing said jet to subdivide into discrete drop which continuously issue from said stressing chamber through said outlet means in a continously-swept pattern of drops rather than a jet; and, wherein said chamber has first and second walls extending between said peripheral sidewalls and said plurality of stressing elements comprises a plurality of undulations in one of said first and second walls.

* * * * *